United States Patent [19]

Yamada et al.

[11] Patent Number: 4,872,806

[45] Date of Patent: Oct. 10, 1989

[54] CENTRIFUGAL PUMP OF VORTEX-FLOW TYPE

[75] Inventors: Yutaka Yamada, Tsushima-shi, Aichi-ken; Tadashi Kozawa; Naohiro Natsume; Hirofumi Komatsubara, all of Oobu, Japan

[73] Assignees: Aisan Kogyo Kabushiki Kaisha, Oobu; Yutaka Yamada, Aichi, both of Japan

[21] Appl. No.: 194,517

[22] Filed: May 16, 1988

[30] Foreign Application Priority Data

May 15, 1987 [JP] Japan ..... 62-119887
Jul. 31, 1987 [JP] Japan ..... 62-192813
Sep. 8, 1987 [JP] Japan ..... 62-224983

[51] Int. Cl.[4] ..... F04D 5/00
[52] U.S. Cl. ..... 415/55.5; 415/104
[58] Field of Search ..... 415/53 T, 213 T, 198.2, 415/93

[56] References Cited

U.S. PATENT DOCUMENTS 4,466,781 8/1984 Kemmner et al. ..... 415/53 T
4,493,620 1/1985 Takei ..... 415/53 T
4,556,363 12/1985 Watanabe et al. ..... 415/53 T
4,573,882 3/1986 Watanabe ..... 415/53 T

FOREIGN PATENT DOCUMENTS 804394 2/1951 Fed. Rep. of Germany ... 415/213 T
2112762 10/1972 Fed. Rep. of Germany ... 415/213 T
58-161191 10/1983 Japan .
210294 9/1986 Japan ..... 415/213 T
673796 6/1952 United Kingdom .

*Primary Examiner*—Robert E. Garrett
*Assistant Examiner*—John T. Kwon
*Attorney, Agent, or Firm*—Berman, Aisenberg & Platt

[57] ABSTRACT

A centrifugal pump of the vortex-flow type includes a pump housing defining therein an arcuate pump chamber in surrounding relationship with a central sealed chamber, and a disc-like impeller rotatably and axially movably assembled within the pump housing and having opposite end faces each forming a close clearance with a corresponding internal end wall of the pump housing between the sealed and pump chambers, the impeller having on either end face of the rim portion thereof a plurality of circumferentially equally spaced vane grooves which cooperate with the pump chamber to produce a discharge pressure therein and being formed with at least one pressure balancing hole extending axially therethrough in the interior of the sealed chamber. The impeller is formed at an intermediate annular portion thereof with a plurality of circumferentially equally spaced axial holes which are opposed to the internal end walls of the pump housing, and the internal end walls of the pump housing are each formed with an arcuate groove which is arranged in surrounding relationship with the sealed chamber and corresponds with the axial holes of the impeller.

5 Claims, 9 Drawing Sheets

CENTRIFUGAL PUMP OF VORTEX-FLOW TYPE

BACKGROUND OF THE INVENTION

1. Field of the Invention

The present invention relates to a centrifugal pump of the vortex-flow type, and more particularly, but not exclusively, to a vortex-flow type pump or a vane type regenerative pump which includes a pump housing defining therein an arcuate pump chamber, and a disc-like impeller rotatably and axially movably assembled within the pump housing to be driven by a drive shaft and having opposite end faces each forming a close clearance with a corresponding internal end wall of the pump housing.

2. Description of the Prior Art

In FIG. 14 there is illustrated such a vortex-flow type single-stage pump as described above, wherein a disc-like impeller I has on either end face of the rim portion thereof a plurality of circumferentially spaced vane grooves V which cooperate with an arcuate pump chamber $R_1$ in a pump housing H to discharge hydraulic fluid under high pressure from a discharge port of the pump chamber. The hydraulic fluid under high pressure tends to radially leak out of the discharge port into a central sealed chamber $R_2$ through close clearances between opposite end faces of the impeller I and corresponding internal end walls of the pump housing and to further leak out of the sealed chamber $R_2$ into a suction port of the pump chamber through the close clearances. Rotation of the impeller causes the hydraulic fluid in the close clearances to radially and circumferentially flow at an approximately half circumferential speed of the impeller. The difference in pressure between chambers $R_1$ and $R_2$ caused by the flow of hydraulic fluid at the circumferential speed is extremely small in comparison with the difference in pressure between suction and discharge ports of the pump chamber $R_1$. As a result, the pressure in sealed chamber $R_2$ becomes an approximately intermediate value between the suction and discharge pressures.

In the case that the impeller is in the form of such a conical disc-like impeller as exaggeratedly illustrated in FIG. 15, the pressures acting on opposite end faces of the impeller respectively at A and B parts of the pump chamber in FIG. 16 occur as illustrated in a graph of FIG. 17 where a solid line represents the pressure distribution on the upper end face of the impeller, and broken lines represent the pressure distribution on the bottom end face of the impeller. The pressure distribution is caused by the fact that although the impeller is applied at the opposite end faces thereof with the same pressure respectively in the chambers $R_1$ and $R_2$, the pressure in a smaller clearance between the bottom end face of the impeller and the corresponding internal end wall of the pump housing changes more greatly than the pressure in a larger clearance between the upper end face of the impeller and the corresponding internal end wall of the pump housing. As a result, the impeller is applied at the low pressure side thereof with an upward thrust force Fa and at the high pressure side thereof with a downward thrust force Fb. As illustrated in FIG. 18, therefore, the upper end faces of impeller I is brought into contact with the internal end wall of the pump housing at the low pressure side, while the bottom end face of impeller I is brought into contact with the internal end of the pump housing at the high pressure side. This results in a noticeable increase of radial pressure gradient at the contact portions with the internal end walls of the pump housing. Thus, the pressure distribution on the impeller I changes as illustrated in FIG. 19. For the foregoing reasons, the impeller I will be defaced by frictional engagement with the internal end walls of the pump housing during rotation thereof, resulting in loss of the power applied to the pump.

In the case that the vortex-flow type pump is in the form of a two stage pump as illustrated in FIG. 20, the pressure in a central sealed chamber $R_2$ becomes approximately equal to the pressure in the discharge port of the first stage and to the pressure in the suction port of the second stage. Thus, the pressure distribution on the opposite end faces of the first stage impeller I is caused as illustrated in FIG. 22, and as illustrated in FIG. 21, the first stage impeller I is brought into contact with the internal end wall of the pump housing due to an upward thrust force applied thereto, resulting in defacement of the upper end face of the first stage impeller and loss of the power applied to the pump. Similarly, the pressure distribution on the opposite end faces of the second stage impeller is caused as illustrated in FIG. 24, and as illustrated in FIG. 23, the second stage impeller is brought into contact with the internal end wall of the pump casing due to a downward thrust force applied thereto, resulting in defacement of the bottom end face of the second stage impeller and loss of the power applied to the pump.

In the case that both the impellers in the two stage pump are each in the form of a flat disc-like impeller, as illustrated in FIG. 25, the second stage impeller is tilted by an upward thrust force applied thereto at the low pressure side thereof and a downward thrust force applied thereto at the high pressure side thereof. The pressure distribution on the opposite end faces of the second stage impeller is caused as illustrated in FIG. 26. This results in an increase of the thrust forces acting on the second stage impeller, causing defacement of the impeller and loss of the power applied to the pump.

SUMMARY OF THE INVENTION

It is, therefore, a primary object of the present invention to provide an improved centrifugal pump of the vortex-flow type capable of decreasing the thrust forces acting on the opposite end faces of the impeller as small as possible for refraining the impeller from frictional engagement with the internal end walls of the pump housing.

In an aspect of the present invention, the primary object is attained by providing a centrifugal pump of the vortex-flow type which comprises a pump housing defining therein an arcuate pump chamber in surrounding relationship with a central sealed chamber, and a disc-like impeller rotatably and axially movably assembled within the pump housing and having opposite end faces each forming a close clearance with a corresponding internal end wall of the pump housing between the sealed and pump chambers, the impeller having on either end face of the rim portion thereof a plurality of circumferentially spaced vane grooves which cooperate with the pump chamber to produce a discharge pressure therein and being formed with at least one pressure balancing hole extending axially therethrough in the interior of the sealed chamber, the pump being characterized in that the impeller is formed at an intermediate annular portion thereof with a plurality of circumferentially spaced axial holes which are opposed to the internal end walls of the pump housing and that the internal end walls of the pump housing are each formed with an arcuate groove which is arranged in surrounding relationship with the sealed chamber and corresponds with the axial holes of the impeller.

In another aspect of the present invention, the primary object is attained by providing a centrifugal pump of the vortex-flow type wherein the opposite end faces of the impeller are each formed at an intermediate annular portion thereof with a plurality of circumferentially spaced arcuate recesses which are each tapered toward an axial hole formed in the impeller at each center of the arcuate recesses, the arcuate recesses being arranged in surrounding relationship with the sealed chamber and opposed to the internal end walls of the pump housing.

BRIEF DESCRIPTION OF THE DRAWINGS

Other objects, features and advantages of the present invention will become more readily apparent from the following detailed description of preferred embodiments thereof when taken together with the accompanying drawings, in which.

DESCRIPTION OF THE PREFERRED EMBODIMENTS

Figure 2:
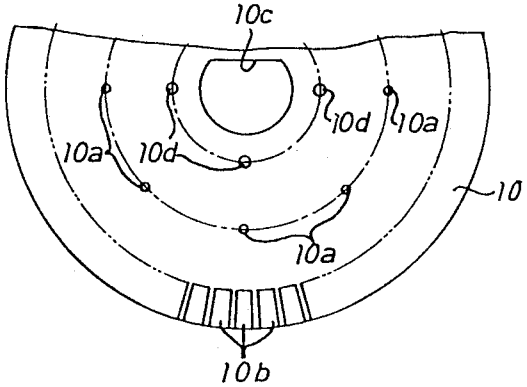
FIG. 2 illustrates partly an upper end face of a conical disc-like impeller shown in FIG. 1.
Figure 1:
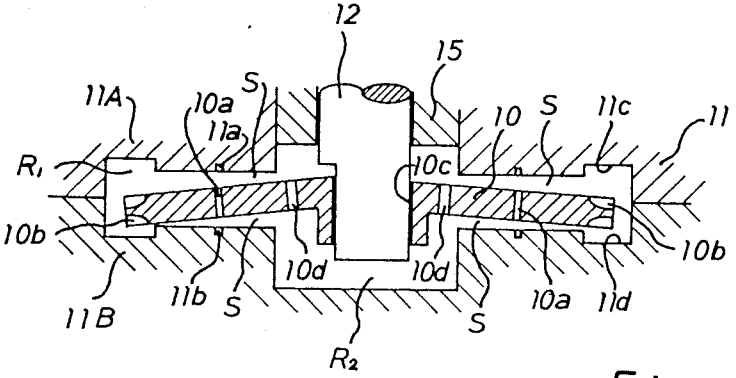
FIG. 1 is a sectional view of a centrifugal pump of the vortex-flow type in accordance with the present invention.

In FIG. 1 of the drawings, there is illustrated in an enlarged scale a centrifugal pump of the vortex-flow type in accordance with the present invention which comprises a conical disc-like impeller 10 rotatably and axially movably assembled within a pump housing 11 defining therein an arcuate pump chamber $R_1$ in surrounding relationship with a central sealed chamber $R_2$. The impeller 10 has opposite end faces each forming a close clearance S (on the order of about 10 to 15 micron) with a corresponding internal end wall of pump housing 11. The impeller 10 has on either end face of the rim portion thereof a plurality of circumferentially spaced vane grooves **10*b* which cooperate with the arcuate pump chamber $R_1$ to produce a discharge pressure therein. The central portion of impeller 10 defines a hub portion having a bore 10*c* adapted to axially movably receive a reduced inner end of a drive shaft 12. As shown in FIGS. 1 and 2, the impeller 10 is formed at an intermediate annular portion thereof with a plurality of circumferentially equally spaced axial holes 10*a* which are opposed to the internal end walls of housing 11 between the pump chamber $R_1$ and sealed chamber $R_2$. The impeller 10 is further formed with a plurality of circumferentially equally spaced pressure balancing holes 10*d*** extending axially therethrough in the interior of sealed chamber $R_2$.

Figure 3:
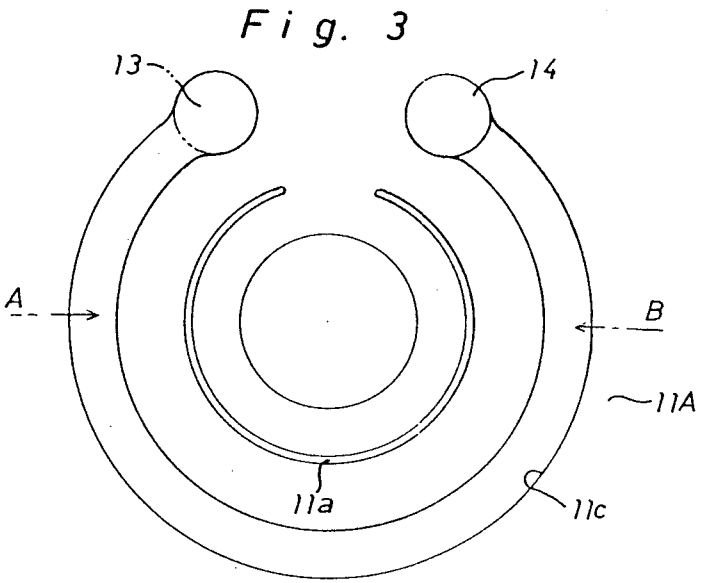
FIG. 3 illustrates an internal end wall of an upper housing section shown in FIG. 1 and an arcuate groove in the upper housing section.

The pump housing 11 includes upper and lower housing sections 11A and 11B coupled in a fluid-tight manner with each other. The housing sections 11A and 11B are provided with arcuate grooves **11*c*, 11*d* which cooperate to form the pump chamber $R_1$. As shown in FIG. 3, the upper housing section 11A is formed at the internal end wall thereof with an arcuate groove 11*a* which corresponds with the axial holes 10*a* of impeller 10. Similarly, the lower housing section 11B is formed at the internal end wall thereof with an arcuate groove 11*b* which corresponds with the axial holes 10*a* of impeller 10. In addition, the upper housing section 11A is provided with a discharge port 14 which opens into the right end of arcuate groove 11*c*, while the lower housing section 11B is provided with a suction port 13 which opens into the left end of arcuate groove 11*d*. The sealed chamber $R_2$ is closed by a bearing member 15 which is coupled in a fluid-tight manner within a corresponding bore in the upper housing section 11A to rotatably support the drive shaft 12**.

Figure 4:
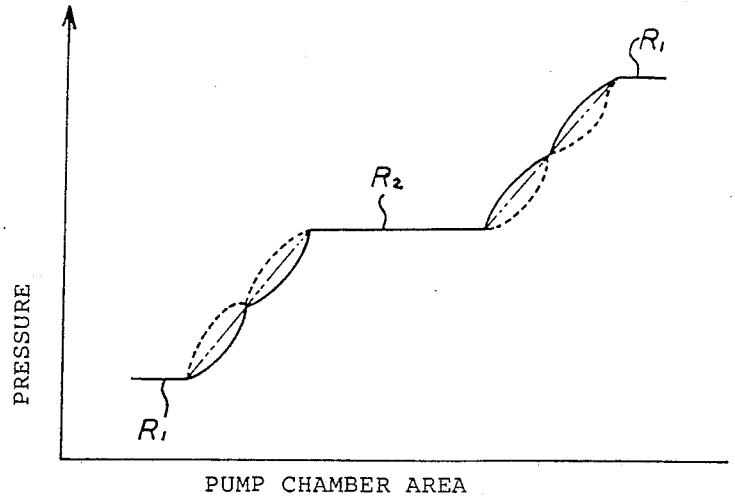
FIG. 4 is a graph illustrating a pressure distribution on the impeller shown in FIG. 1.

In operation of the vortex-flow type centrifugal pump described above, the arcuate grooves **11*a* and 11*b* in the internal end walls of housing 11 cooperate with the axial holes 10*a* of impeller 10 to cause a pressure distribution between the pump chamber $R_1$ and sealed chamber $R_2$ as illustrated in FIG. 4. In such a pressure distribution, the pressure acting on the opposite end faces of impeller 10 between the chambers $R_1$ and $R_2$ are balanced uniformly in a circumferential direction. This if effective to noticeably reduce a thrust force each acting on the opposite end faces of impeller 10 thereby to refrain the impeller from frictional engagement with the internal end walls of housing 11. As a result, the defacement of impeller 10** can be reduced to enhance the pumping efficiency and durability of the pump.

In a practical embodiment, the axial holes 10*a* of impeller 10 are each formed possibly small in diameter and the arcuate grooves 11*a*, 11*b* are each formed possibly small in width and possibly shallow. In such an arrangement, a sufficient sealing area can be obtained between the pump chamber $R_1$ and sealed chamber $R_2$ to avoid a decrease of the pumping efficiency caused by leakage of the hydraulic fluid across the close clearances S. Furthermore, the clearances S between chambers $R_1$ and $R_2$ can be formed large in radial width since the impeller 10 is refrained from frictional engagement with the internal end walls of housing 11 in spite of the presence of tolerance in the close clearances S. This is effective to reduce leakage of the hydraulic fluid across the close clearances S so as to enhance the pumping efficiency. Additionally, the arcuate grooves 11*a*, 11*b* in the internal end walls of housing 11 serves to receive the hydraulic fluid flowing radially inwardly from the discharge port 14 across the close clearances S and to restrict the flow of hydraulic fluid toward the suction port 13.

Figure 5:
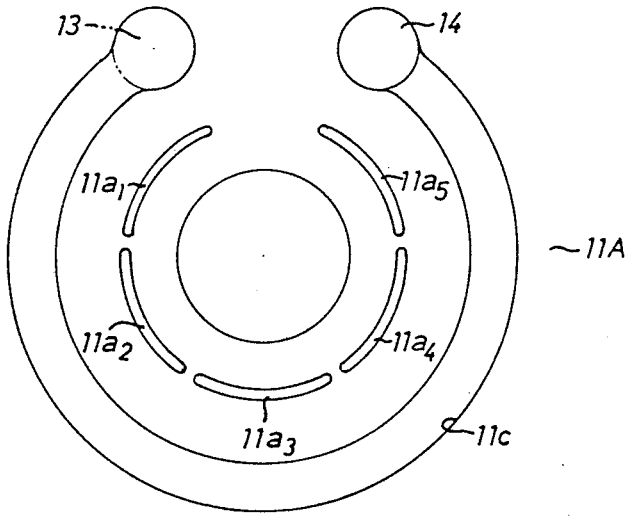
FIG. 5 illustrates a modification of the internal end wall of the upper housing section shown in FIG. 1.
Figure 8:
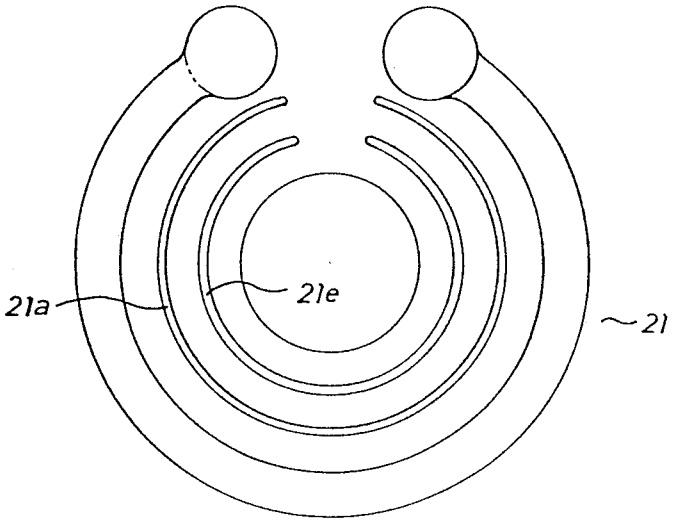
FIG. 8 illustrates an internal end wall of an upper housing section shown in FIG. 6 and an arcuate groove in the upper housing section.
Figure 6:
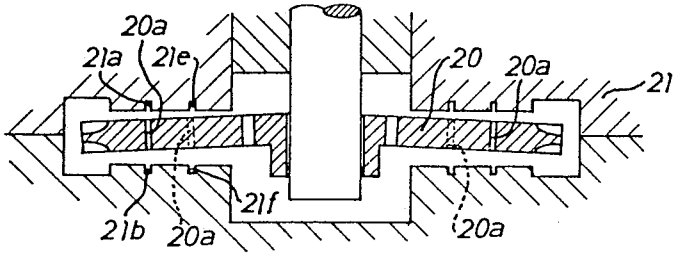
FIG. 6 is a sectional view of a modification of the vortex-flow type centrifugal pump shown in FIG. 1.
Figure 7:
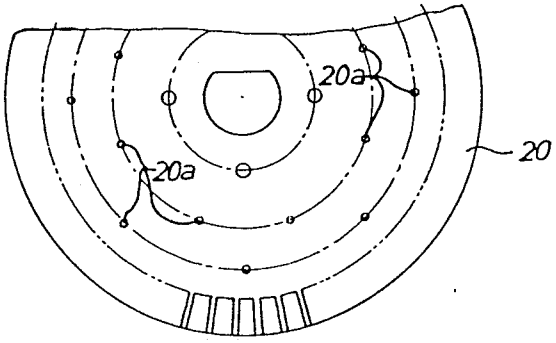
FIG. 7 illustrates partly an upper end face of a conical disc-like impeller shown in FIG. 6.

In another practical embodiment, the arcuate grooves 11*a*, 11*b* in the internal end walls of housing 11 each may be circumferentially subdivided into separate arcuate segments as shown by reference numerals $11a_1$–$11a_5$ in FIG. 5. In this embodiment, the separate arcuate segments act to more reliably interrupt the hydraulic fluid flowing from the discharge port 14 toward the suction port 13 across the close clearances S. Furthermore, the vortex-flow type centrifugal pump of FIG. 1 may be modified as illustrated in FIGS. 6 to 8, wherein the impeller 10 is replaced with a conical disc-like impeller 20 which is formed at an intermediate annular portion thereof with two parallel rows of circumferentially equally spaced axial holes 20*a* and wherein the pump housing 11 is replaced with a pump housing 21 which includes an upper housing section formed at an internal end wall thereof with two parallel rows of arcuate grooves 21*a* and 21*e* and a lower housing section formed at an internal end wall thereof with two parallel rows of arcuate grooves 21*b* and 21*f*. In such a modification, the arcuate grooves 21*a*, 21*e*, 21*b*, 21*f* in the internal end walls of housing 21 cooperate with the axial holes 20*a* of impeller 20 to uniformly balance the pressures acting on the opposite end faces of impeller 20 at their intermediate annular portions at two regions.

Figure 9:
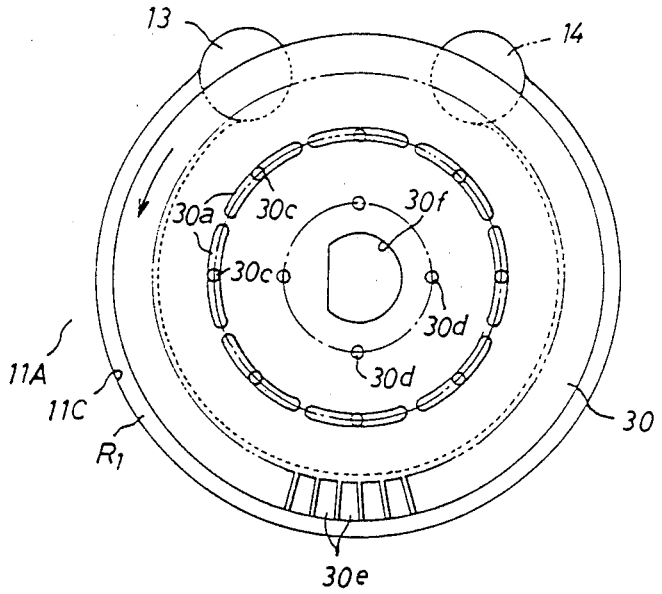
FIG. 9 illustrates another modification of the vortex-flow type centrifugal pump shown in FIG. 1.
Figure 10:
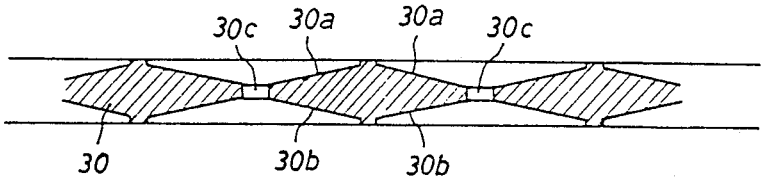
FIG. 10 is an enlarged sectional view of a portion of a disc-like impeller shown in FIG. 9.

In FIG. 9, there is illustrated another modification of the vortex-flow type centrifugal pump of FIG. 1, wherein the impeller 10 is replaced with a conical disc-like impeller 30 the opposite end faces of which are each formed at an intermediate annular portion thereof with a plurality of circumferentially equally spaced arcuate recesses 30*a* and 30*b* as shown in FIGS. 9 and 10. The impeller 30 is further formed at the intermediate annular portion thereof with a plurality of circumferentially equally spaced axial holes 30*c* which are arranged at each center of the arcuate recesses 30*a* and 30*b*. The arcuate recesses 30*a* and 30*b* are each formed with a pair of bottom surfaces inclined toward each of the axial holes 30*c*. The impeller 30 has pressure balancing holes 30*d*, vane grooves 30*e* and a bore 30*f* which correspond with the pressure balancing holes 10*d*, vane grooves 10*b* and bore 10*c* in the pump of FIG. 1. In this modification, it is not necessary to provide the arcuate grooves 11*a* and 11*b* in the internal end walls of housing 11. The other construction and components are substantially the same as those of the pump shown in FIG. 1.

In operation of the modification shown in FIGS. 9 and 10, the arcuate recesses 30*a* and the axial holes 30*c* of impeller 30 cooperate with the corresponding internal end walls of housing 11 to uniformly balance the pressures acting on the opposite end faces of impeller 30 between the pump chamber $R_1$ and sealed chamber $R_2$. This is effective to noticeably reduce a thrust force each acting on the opposite end faces of impeller 30 thereby to refrain the impeller 30 from frictional engagement with the internal end walls of housing 11. As a result, the defacement of impeller 30 can be reduced to enhance the pumping efficiency and durability of the pump. Similarly to the pump shown in FIG. 1, it is preferable that the arcuate recesses 30*a* and axial holes 30*c* are formed possibly small in width and in diameter, respectively. In such an arrangement, a sufficient sealing area can be obtained between the pump chamber $R_1$ and sealed chamber $R_2$ to avoid a decrease of the pumping efficiency caused by leakage of the hydraulic fluid across the close clearances S. Furthermore, the clearances S between chambers $R_1$ and $R_2$ can be formed large in radial width since the impeller 30 is refrained from frictional engagement with the internal end walls of housing 11 in spite of the presence of tolerance in the close clearances S. This is effective to reduce leakage of the hydraulic fluid across the close clearances S so as to enhance the pumping efficiency.

Figure 11:
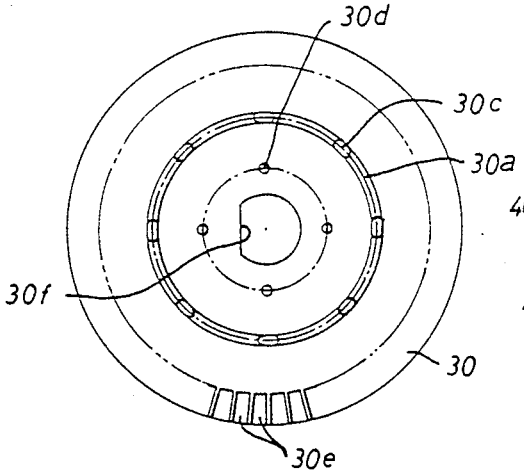
FIGS. 11 to 13 illustrate other modifications of the impeller shown in FIG. 9.
Figure 12:
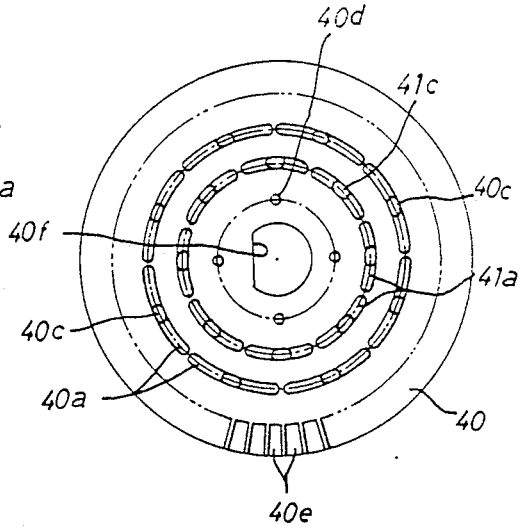
Figure 13:
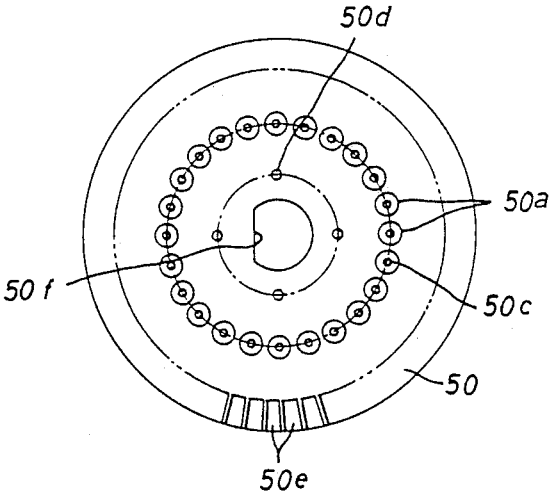
Figure 15:
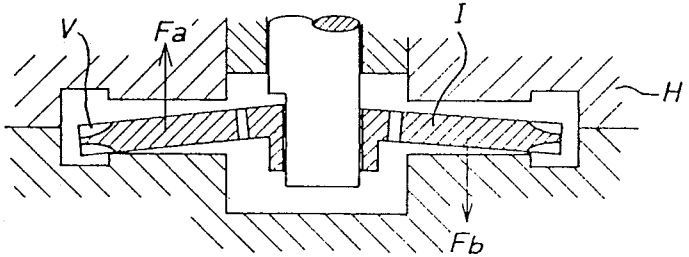
Fig. 15 (PRIOR ART)
FIG. 15 is an enlarged sectional view of the pump shown in FIG. 14.
Figure 16:
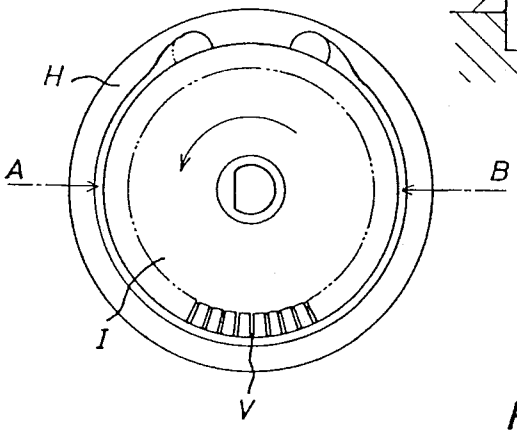
Fig. 16 (PRIOR ART)
FIG. 16 is an enlarged plan view of a disc-like impeller shown in FIG. 14.
Figure 14:
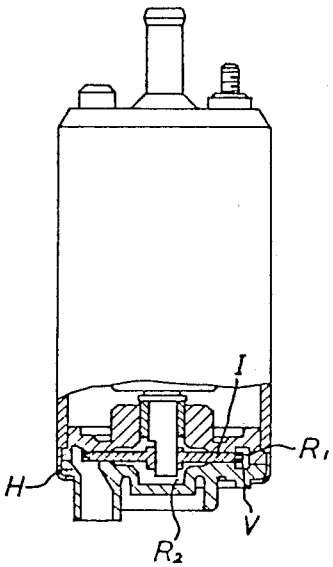
Fig. 14 (PRIOR ART)
FIG. 14 is a partly broken side view of a conventional centrifugal single stage pump of the vortex-flow type.
Figure 17:
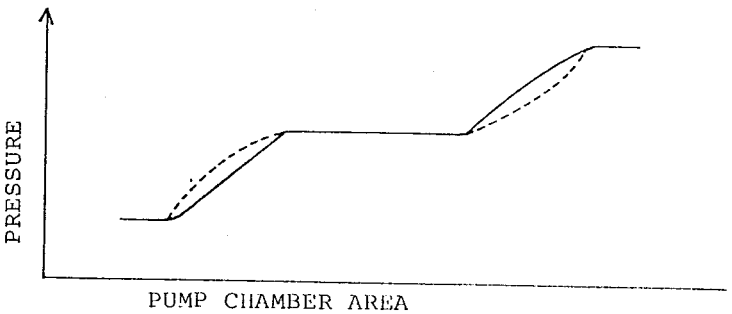
Fig. 17 (PRIOR ART)
FIG. 17 is a graph illustrating a pressure distribution on the impeller shown in FIG. 15.
Figure 18:
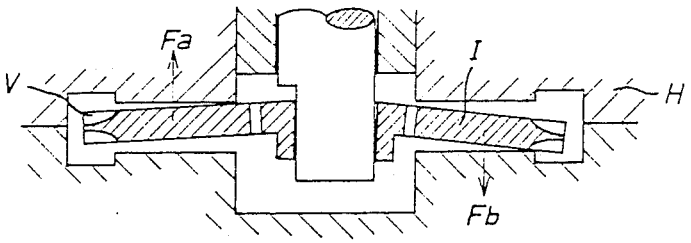
Fig. 18 (PRIOR ART)
FIG. 18 illustrates thrust forces acting on the impeller shown in FIG. 15.
Figure 19:
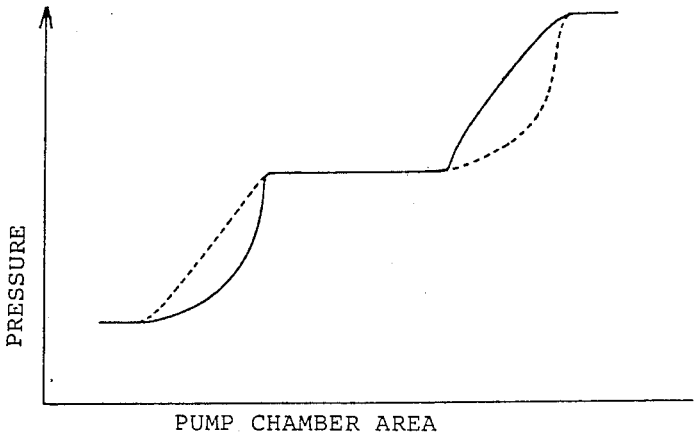
Fig. 19 (PRIOR ART)
FIG. 19 is a graph illustrating a pressure distribution on the impeller shown in FIG. 18.
Figure 21:
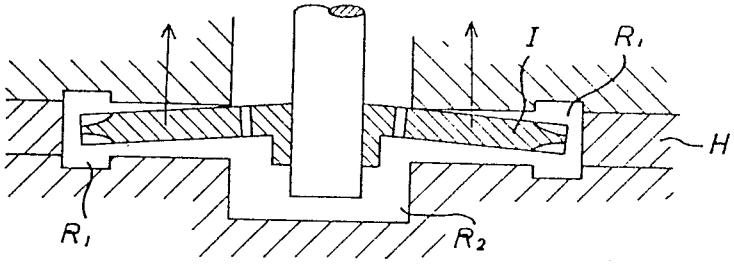
Fig. 21 (PRIOR ART)
FIG. 21 is an enlarged sectional view of the first stage part of the pump shown in FIG. 20.
Figure 22:
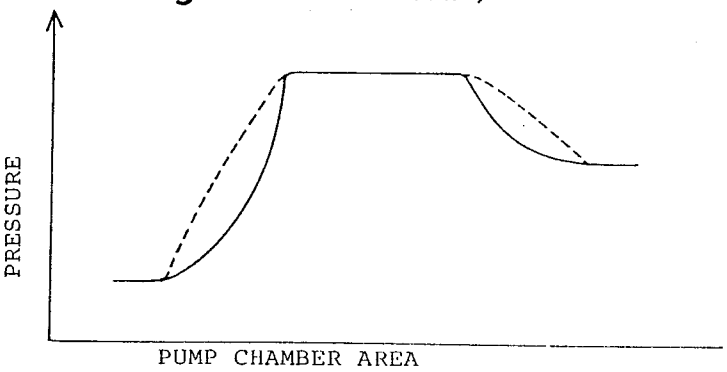
Fig. 22 (PRIOR ART)
FIG. 22 is a graph illustrating a pressure distribution on a conical disc-like impeller shown in FIG. 21.
Figure 20:
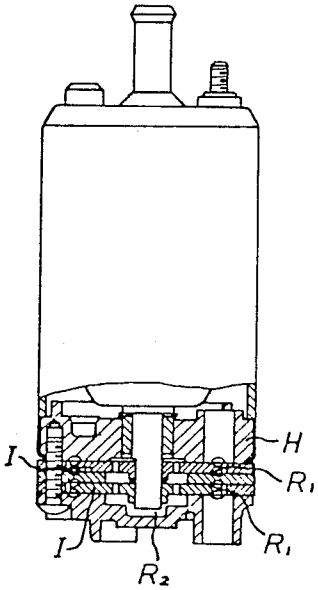
Fig. 20 (PRIOR ART)
FIG. 20 is a partly broken side view of a conventional vortex-flow type two stage pump.
Figure 23:
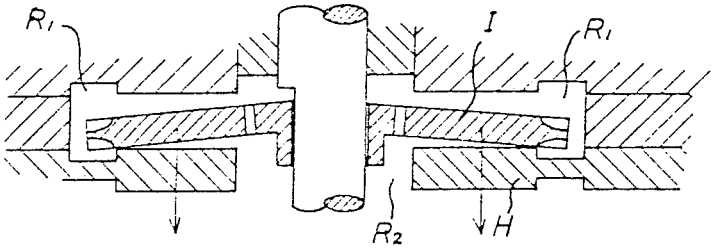
Fig. 23 (PRIOR ART)
FIG. 23 is an enlarged sectional view of the second stage part of the pump shown in FIG. 20.
Figure 24:
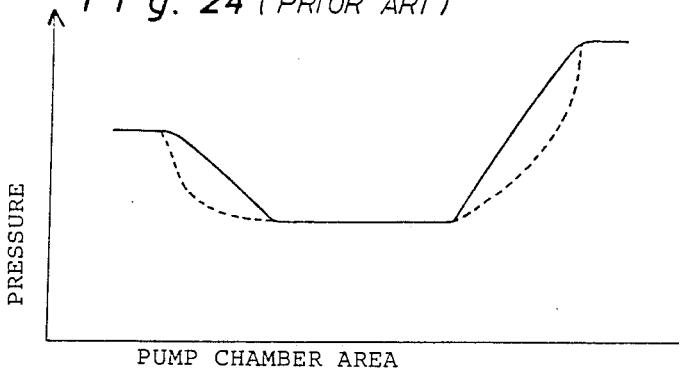
Fig. 24 (PRIOR ART)
FIG. 24 is a graph illustrating a pressure distribution on a conical disc-like impeller shown in FIG. 23.
Figure 25:
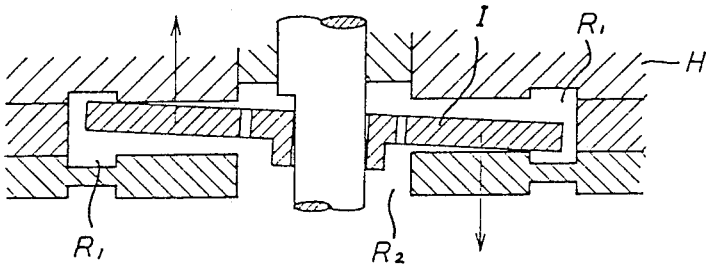
Fig. 25 (PRIOR ART)
FIG. 25 is an enlarge sectional view of a flat disc-like impeller substituted for the conical disc-like impeller shown in FIG. 23.
Figure 26:
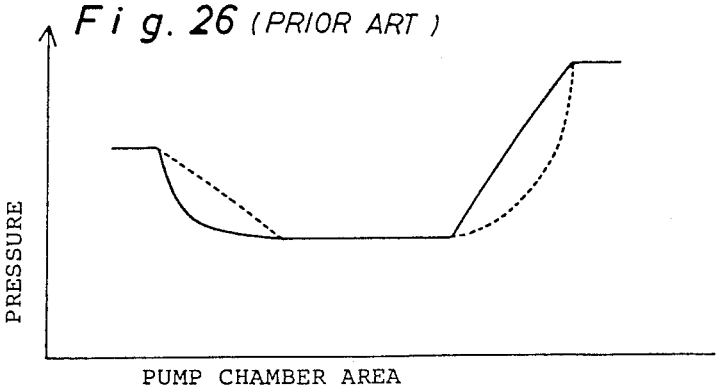
Fig. 26 (PRIOR ART)
FIG. 26 is a graph illustrating a pressure distribution on the impeller shown in FIG. 25.

In a practical embodiment, the impeller 30 of FIG. 9 may be further modified as illustrated in FIG. 11, wherein the arcuate recesses 30*a* are annularly formed and wherein the axial holes 30*c* each are in the form of an elongated axial hole. Alternatively, as shown in FIG. 12, the impeller 30 may be replaced with a disc-like impeller 40 the opposite end faces of which are each formed at an intermediate annular portion thereof with two parallel rows of circumferentially equally spaced arcuate recesses 40*a* and 41*a* which are arranged in surrounding relationship with the sealed chamber $R_2$ and tapered toward an axial hole 40*c*, 41*c* formed in the impeller at each center of the arcuate recesses 40*a*, 41*a*. The impeller 30 may be also replaced with a disc-like impeller 50 illustrated in FIG. 13. The impeller 50 has opposite end faces which are each formed at an intermediate annular portion thereof with a plurality of circumferentially equally spaced circular recesses 50*a* which are each tapered toward an axial hole 50*c* formed in the impeller at each center of the recesses 50*a*.

Having now fully set forth both structure and operation of certain preferred embodiments of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A centrifugal pump of the vortex-flow type comprising a pump housing defining therein an arcuate pump chamber in surrounding relationship with a central sealed chamber, and a disc-like impeller rotatably and axially movably assembled within said pump housing and having opposite end faces each forming a close clearance with a corresponding internal end wall of the pump housing between the sealed and pump chambers, said impeller having on either end face of the rim portion thereof a plurality of circumferentially spaced vane grooves which cooperate with the pump chamber to produce a discharge pressure therein and being formed with at least one pressure balancing hole extending axially therethrough in the interior of the sealed chamber, wherein the opposite end faces of said impeller are each formed at an intermediate annular portion thereof with a plurality of circumferentially spaced arcuate recesses which are arranged in surrounding relationship with the sealed chamber and tapered toward an axial hole formed in said impeller at each center of said arcuate recesses.

2. A centrifugal pump as claimed in claim 1, wherein the arcuate recesses of said impeller are annularly formed.

3. A centrifugal pump as claimed in claim 1, wherein said axial holes of said impeller each are in the form of an elongated axial hole.

4. A centrifugal pump as claimed in claim 1, wherein the opposite end faces of said impeller are each formed at an intermediate annular portion thereof with at least two parallel rows of circumferentially spaced arcuate recesses which are arranged in surrounding relationship with the sealed chamber and tapered toward an axial hole formed in said impeller at each center of said arcuate recesses.

5. A centrifugal pump as claimed in claim 1, wherein the opposite end faces of said impeller are each formed at an intermediate annular portion thereof with a plurality of circumferentially spaced circular recesses which are arranged in surrounding relationship with the sealed chamber and each tapered toward an axial hole formed in said impeller at each center of said circular recesses.

* * * * *